United States Patent [19]

Bauer

[11] 4,351,701

[45] Sep. 28, 1982

[54] METHOD OF CONTROLLING A COKING CYCLE

[75] Inventor: Edmund G. Bauer, Allentown, Pa.

[73] Assignee: Bethlehem Steel Corporation, Bethlehem, Pa.

[21] Appl. No.: 224,405

[22] Filed: Jan. 12, 1981

[51] Int. Cl.[3] ..... C10B 5/00

[52] U.S. Cl. ..... 201/1; 202/263; 340/628; 324/62

[58] Field of Search ..... 201/1; 202/263, 262; 340/617, 628, 627; 324/62

[56] References Cited

U.S. PATENT DOCUMENTS 3,607,660 9/1971 Kemper ..... 201/1
3,975,240 8/1976 Seeberg et al. ..... 201/1
4,045,292 8/1977 Matsuchita et al. ..... 201/1
4,158,610 6/1979 Bauer et al. ..... 201/1

*Primary Examiner*—Norman Yudkoff
*Attorney, Agent, or Firm*—Joseph J. O'Keefe; Michael J. Delaney

[57] ABSTRACT

The endpoint of devolatilization of a coal mass in a coke oven during a coking cycle is determined by providing a probe which is capable of supplying an electrical signal which indicates the effective thickness of a layer of carbon deposited on the probe by gas released from the coal mass and in addition indicates the rate of devolatilization of the coal mass which is a measure of the heat input to the coal mass and can be used to control heat input to the coke oven.

5 Claims, 9 Drawing Figures

FIG. 7 PRIOR ART
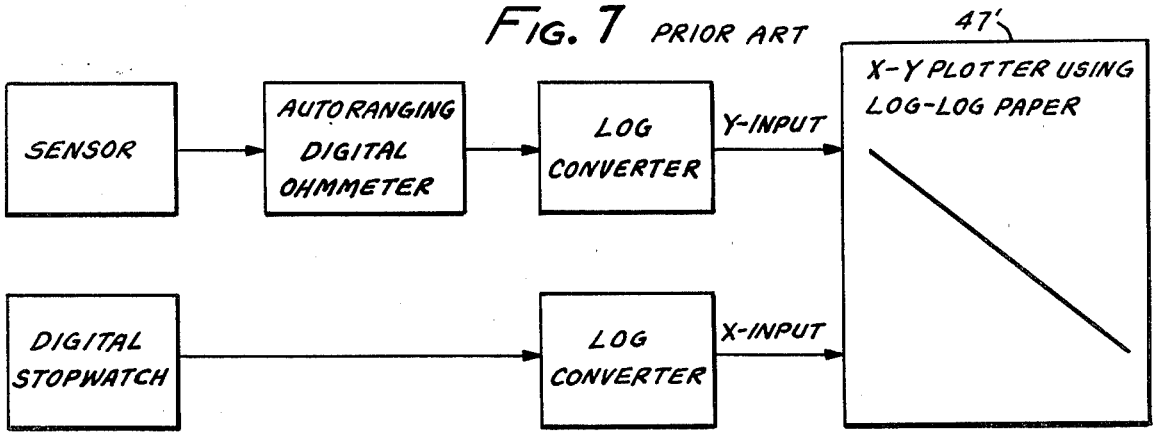
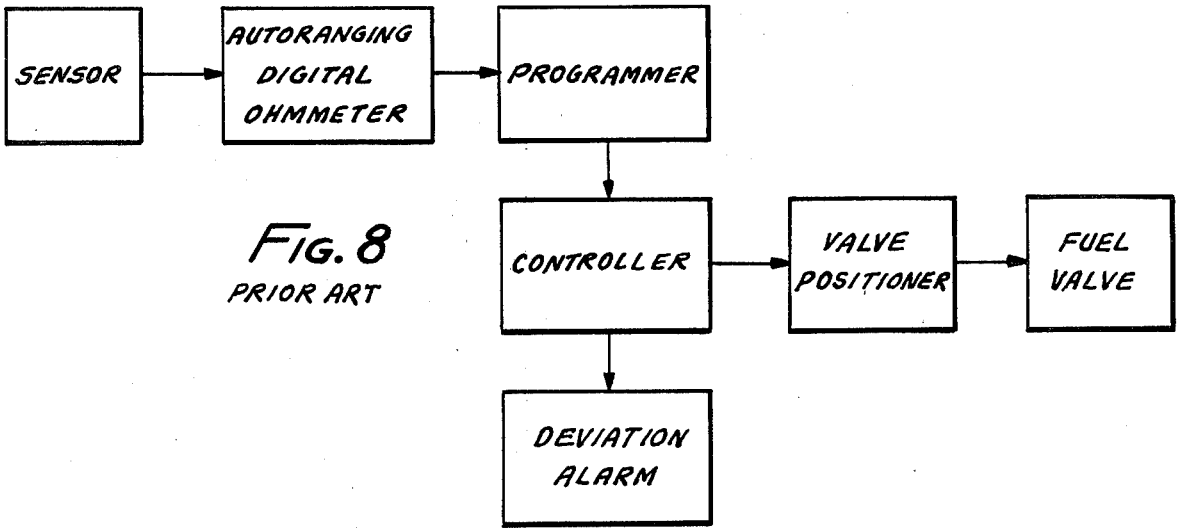
FIG. 8
PRIOR ART
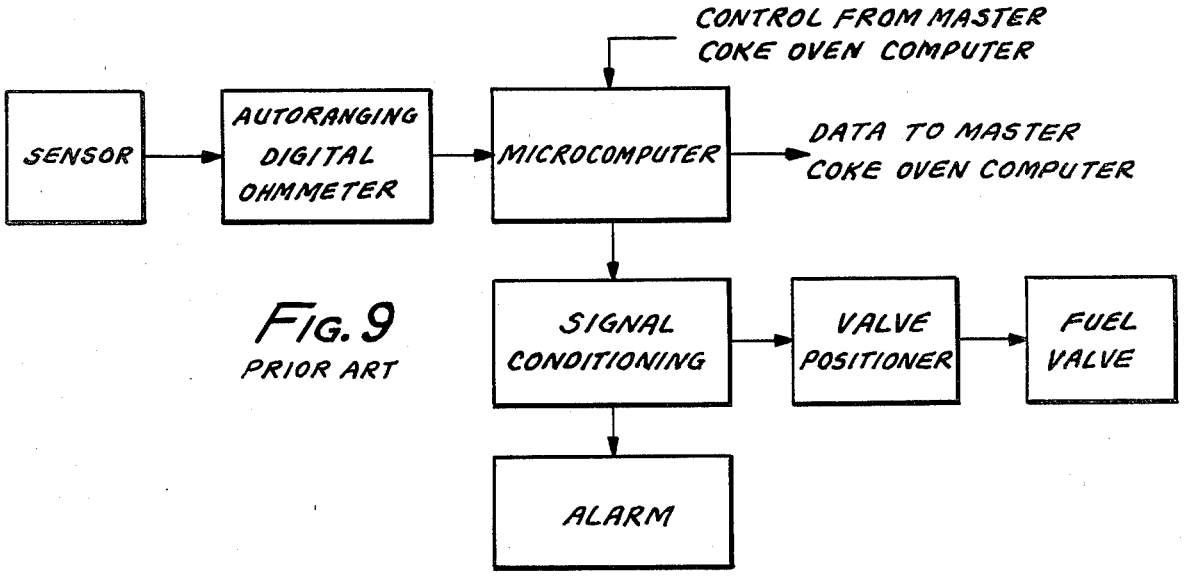
FIG. 9
PRIOR ART

METHOD OF CONTROLLING A COKING CYCLE

BACKGROUND OF THE INVENTION

The end of a coking cycle is usually defined by specifying the temperature to which the center of the coke mass must be heated, typically 1800° F. Since it is not practical to insert thermocouples into the coke mass in every coking cycle to directly obtain a temperature reading, indirect methods have been used in an attempt to determine the end of the coking cycle. For example, thermocouples have been placed above the coke mass and into the piping carrying the gas given off by the coal during the coking cycle.

Conventionally, the end of a coking cycle is determined by adding a predetermined time period to the time at which the thermocouples indicate a drop in the temperature. The drop in temperature indicates that hot gases no longer flow from the coke mass through the piping. If the cessation of gas flow is due to the end of devolatilization of the coal, the remainder of the coking cycle is devoted to bringing the coke mass to the required temperature. However, if the drop in temperature is due to other reasons, e.g. operating procedures which divert gas flow from one piping arrangement at one side of a coke oven to the other side, the thermocouples may indicate a drop in temperature and suggest that devolatilization of the coal mass has ended when in fact it has not ended. As a result, the coke mass would be pushed from the coke oven too soon. Upon seeing that the coke mass was pushed too soon, the coke oven operator may overcompensate by allowing an excessive coking time which reduces the production rate of coke or increasing the underfiring rate thus overheating the coke mass.

Thus there is a need for an apparatus and method to more accurately determine the true devolatilization end-point which apparatus and method are not affected by operating procedures including diverting gas flow from the coke mass.

INCORPORATION BY REFERENCE

This application incorporates by reference the specification and drawings of U.S. Pat. No. 4,158,610 issued June 19, 1979 to Inventors, Edmund G. Bauer and Glenn E. Shadle and assigned to Bethlehem Steel Corporation.

SUMMARY OF THE INVENTION

This invention relates generally to a method of determining and controlling the end of a coking cycle and specifically to determining and controlling the endpoint of devolatilization of a coal mass during a coking cycle.

It is an object of this invention to closely control a coking cycle in order to produce coke having the proper properties including size distribution, stability, hardness, and reactivity.

It is also an object of this invention to control coking cycle in order to produce coke in an efficient manner.

It is another object of this invention to provide a method which determines the true devolatilization end-point during a coking cycle.

It is still another object of this invention to provide a method which indicates the rate of devolatilization to control heat input during the coking cycle.

The above objects can be obtained by a method which utilizes the apparatus and method shown and described in U.S. Pat. No. 4,158,610 to measure the effective thickness of a layer of carbon deposited by gas released from coal during a coking cycle on the probe of such apparatus, positioning the probe such that it is exposed to the gas, providing means electrically connected to the probe to indicate the effective thickness, and means electrically connected to the probe to indicate the rate of increase of the effective thickness and to control the heat input to the coking cycle.

BRIEF DESCRIPTION OF THE DRAWINGS

FIGS. 7 through 9 inclusive are block diagrams of alternate embodiments.

DETAILED DESCRIPTION OF THE DRAWINGS

Figure 1:
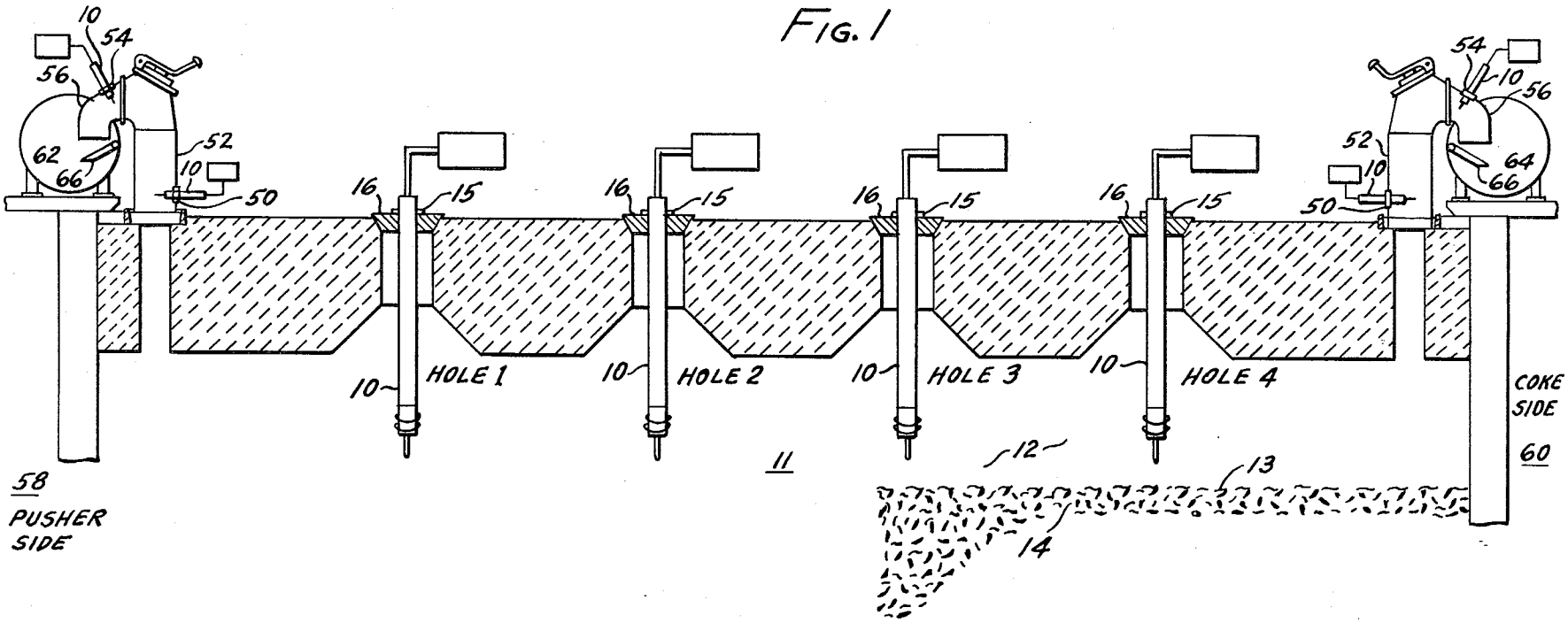
FIG. 1 is a partial cross sectional view of the upper portion of a coke oven.

Referring to FIG. 1 the probe 10 of a construction and operation as described in U.S. Pat. No. 4,158,610 is shown placed in a coke oven 11. The probe 10 may be placed through a fitting 15 in charging hole lid 16 at charging holes 1, 2, 3 or 4 such that the probe 10 extends into the free space 12 above the coal line 13 of the coal charge 14. The probe 10 may also be placed through a fitting 50 and extend within standpipe 52 or placed through a fitting 54 and extend within gooseneck 56. A standpipe 52 and gooseneck 56 are located at both the pusher side 58 and the coke side 60 of the coke oven 11 and are in communication with a pusher side main 62 and a coke side main 64. A damper 66 is located at the point where the gooseneck 56 enters its respective main 62 or 64. Thus probe 10 may be located in 1ne or more of the following locations, that is charging holes 1,2,3,4; pusher side gooseneck 56; coke side gooseneck 56; pusher side standpipe 52; coke side standpipe 52; and any other location so that the probe 10 is exposed to gas released from the coal charge 14 during the coking cycle.

As the coal charge 14 is heated in the coke oven 11, volatiles are driven off or released from the coal charge. Thus volatiles in the coal are driven off by a process of devolatilization. The time when the coal charge ceases to give off volatiles is termed the devolatilization end-point.

Figure 4:
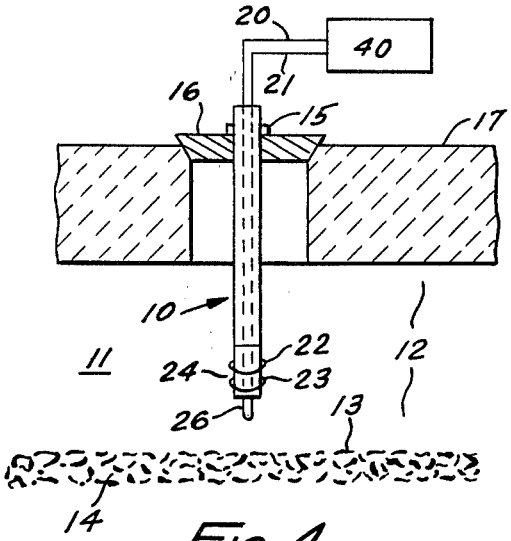
FIG. 4 PRIOR ART
FIG. 4 is a general arrangement of the apparatus of the instant invention.

Referring to FIG. 4, the probe 10 is seen in place in coke oven 11 extending into the free space 12 above coal line 13 of the coal charge 14. Probe 10 is inserted through a fitting 15 in charging hole lid 16 in the coke oven roof 17. Lead wires 20 and 21 connect first and second spaced apart wires 22 and 23, respectively, encircling the measurement area 24 of the lower portion of probe 10 with electronics package 40 which is located remotely from the coke oven 11. The wires 22 and 23 serve as electrodes.

Figure 5:
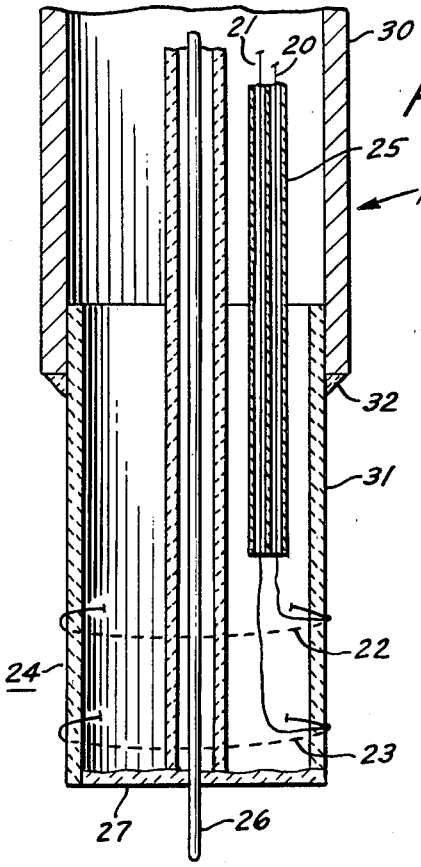
FIG. 5 PRIOR ART
FIG. 5 is an enlarged fragmentary detailed drawing of the probe.

FIG. 5 is an enlarged fragmentary detail of probe 10. The probe 10 is a cylinder and comprises a ½ inch diameter stainless steel tube upper portion 30. The lower portion 31 is a 9.5 mm ceramic tube inserted into the lower end of the stainless steel tube upper portion 30 and is affixed thereto by ceramic cement as at 32 and extending downward therefrom approximately three inches. Spaced apart wires 22 and 23 are seen encircling the ceramic tube 31 in the measurement area 24 of the probe 10 and are connected by lead wires 20 and 21, respectively, to the electronics package 40 as seen in FIG. 4. The lead wires 20 and 21 are protected by a $\frac{1}{8}$ inch, 2 hole ceramic insulator 25, each lead wire occupying one of the channels or holes through the tubular insulator 25. A 1/16 inch diameter sheathed type K thermocouple 26 is provided in probe 10 extending therethrough and protruding at the lower end thereof into the coke oven free space slightly to register the temperature of the gases therein. The lower end of the probe 10 is sealed by ceramic cement as at 27. The top of the probe 10 cylinder is also sealed.

Figure 6:
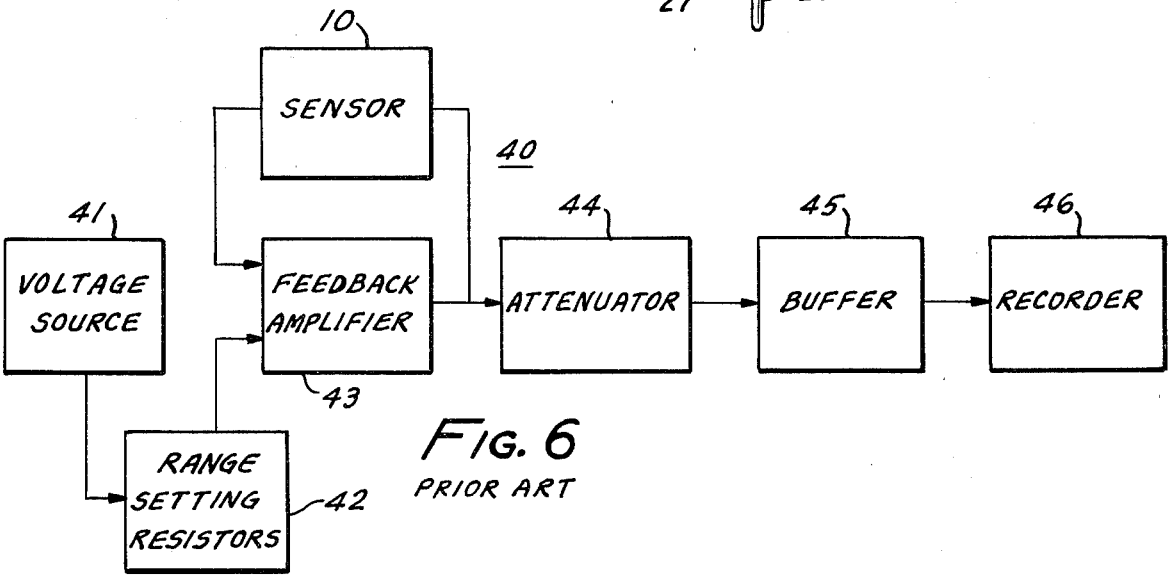
FIG. 6 PRIOR ART
FIG. 6 is a block diagram showing the electronics package of the preferred embodiment.

The system for measuring the effective thickness of a layer of carbon deposited by a gas in a coke oven comprises the specially designed sensor or probe 10, signal processing electronics 40, and a standard voltage vs. time chart recorder 46, (FIG. 6).

The sensor of probe 10 is constructed entirely of materials designed to withstand the highly corrosive, high temperature environment of the coke oven. The dimensions and materials of the sensor or probe 10 shown in FIG. 5 are selected for system compatibility, although other combinations of dimensions would be suitable. The two spaced apart wires 22 and 23 located near the end of the sensor or probe 10 serve as the electrodes. The area between the electrodes 22 and 23 on the outside surface of the ceramic tube 31 comprises the measuring area 24 of the sensor 10. The electrical resistance between the two electrodes 22 and 23 is in excess of 10 million ohms, until the carbon formation begins. As the carbon buildup occurs, the electrical resistance of the sensor decreases proportionately. The effective thickness of the carbon buildup is obtained from the slope of the resistance vs. time curve and other physical parameters described in the equation:

$$t=(\rho l/\pi D\beta T^X)$$

where t=effective thickness of buildup
l=gage length of probe
D=diameter of probe
$\rho$=electrical resistivity of the carbon
$\beta$=measured electrical resistance of probe at time zero
T=time
X=slope of resistance-time curve.

The electronics package 40 as shown in FIG. 6 comprises voltage source 41, range setting resistors 42, feedback amplifier 43, attenuator 44, buffer 45 and recorder 46.

The signal processing electronics package 40 accepts the electrical resistance information from the sensor 10 and processes it for introduction to the recorder 46. A 5-volt signal is generated by the voltage source 41 and is supplied to the feedback amplifier 43 through the range setting resistors 42. These resistors 42 scale the 5-volt signal to provide a decade change of resistance in the system for each resistor step. The 5-volt level is selected to provide adequate signal to reduce the effect of electrical noise in the system. The switching of the range setting resistors 42 can be done manually or under the control of the recorder 46, as the probe or sensor 10 resistance changes decades. This feature enables high resistance sensitivity over the six decades of sensor resistance change. The signal input to the feedback amplifier 43 is amplified in proportion to the value of the sensor 10 resistance in the feedback circuit of the amplifier 43. Full scale recorder input results in all ranges when the resistance of the range setting resistor equals the sensor resistance. The purpose of the feedback amplifier 43 is to provide a relatively constant input loading for the recorder 46. The output of the feedback amplifier 43 is then attenuated to the level required for recorder operation, and buffered to match the input impedance of the recorder 46.

The recorder 46 is a standard potentiometric strip chart recorder which feeds chart paper at a calibrated rate and provides a continuous record of voltage vs. time on the chart.

Materials which can stand up to the temperatures, as high as 2000° F., and corrosive atmosphere of the coke oven free space 12 are essential. The probe 10 described herein uses platinum wire for those wires which are used for measurement purposes, e.g., electrodes 22 and 23. Any high melting point material with a low electrical resistance may be used. Stainless steel is used for the structural sheath or upper portion of cylinder 30.

The material between the wires at the measuring section must have an electrical resistance that is infinite compared to the electrical resistance of carbon. For example, the ceramic material must have an electrical resistance greater than one million ohms. A ceramic material, e.g., alumina having 99.7% purity is used in the probe described hereinabove. A low purity alumina contaminates the platinum and could cause an increase in the electrical resistance of the platinum. All holes and the ends of the probe 10 must be sealed to prevent pyrocarbon from bridging the platinum lead wires 20 and 21.

The thermocouple 26 is used to determine the oven free space 12 temperature. This is useful in relating carbon formation to changes in operation variables. Once this relationship has been established, the operators can use free space temperatures as a quick spot check for potential roof carbon problems.

The probe is inserted into an empty oven through the lid of the coke oven charging hole and soaked to operating temperature prior to use, thereby optimizing the resistance of the carbon thickness probe. The oven to be studied is charged and immediately after charging, the probe is removed from the empty oven and inserted into the charged oven. The electronics and recorder are hooked up and the resistance and free space temperature are recorded throughout the entire coking cycle. The buildup of carbon can be determined from the expression:

$$t=(\rho l/\pi D\beta T^X)$$

where t=effective thickness of buildup
l=gauge length of probe
D=diameter of probe
$\rho$=electrical resistivity of the carbon
$\beta$=measured electrical resistance of probe at time zero
T=time
X=slope of resistance-time curve. Changing process variables with influence $\rho$ and X. Changing the probe will influence l, D, and $\beta$.

Figure 2:
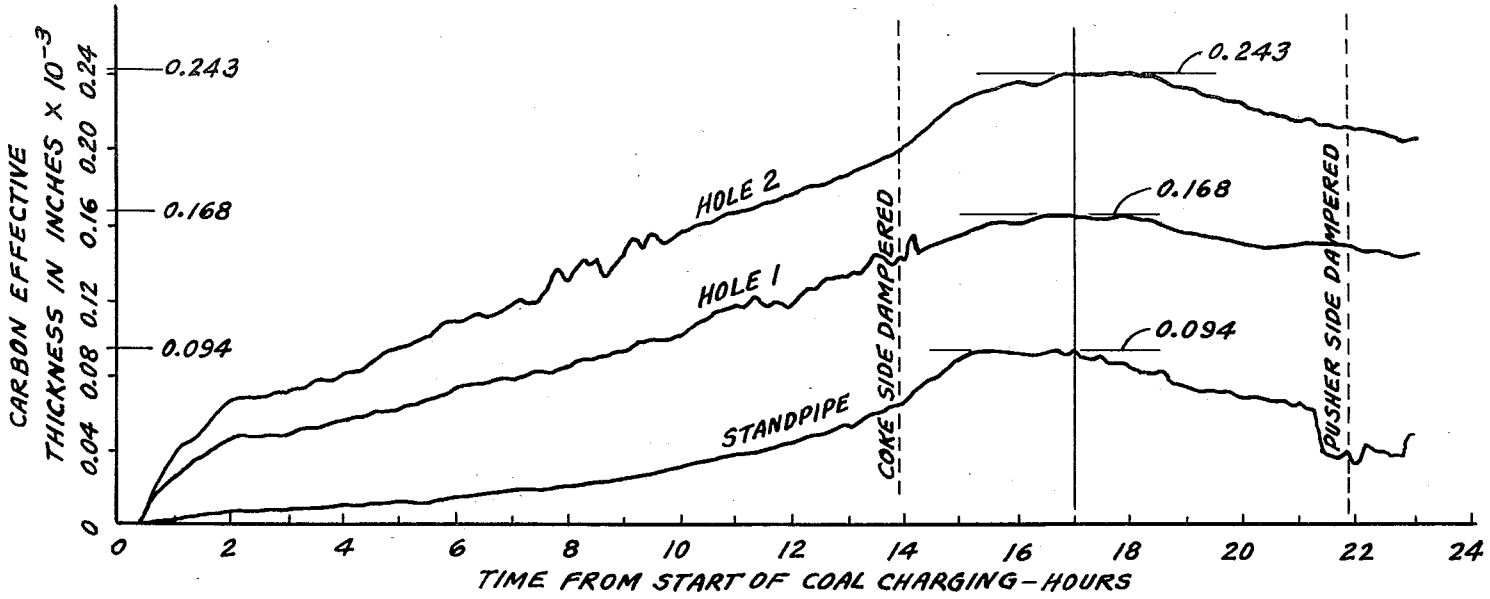
FIG. 2 is a typical effective thickness v. time chart developed through the means of this invention.
Figure 3:
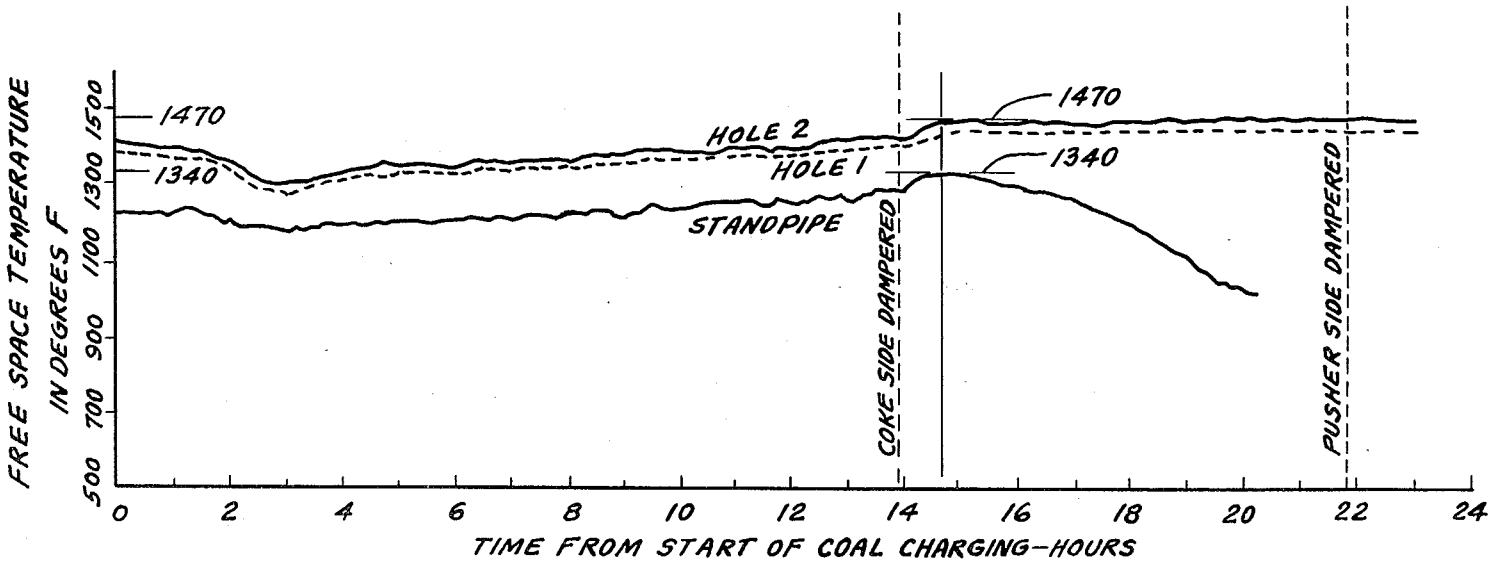
FIG. 3 is a typical temperature v. time chart developed through the means of the prior art.

Referring to FIGS. 2 and 3, the same six meter coke oven during the same coking cycle was equipped with thermocouples in charging hole numbers 1 and 2 and in pusher side standpipe 52 of FIG. 1 and at the same time equipped with the probe 10 in charging hole numbers 1 and 2 and pusher side standpipe 52.

FIG. 2 is a plot of effective carbon thickness in inches versus time of coking in hours. The carbon thickness was determined by the apparatus of U.S. Pat. No. 4,158,610. The total coking time was about 23 hours and the maximum effective carbon thickness was about $0.243\times10^{-3}$ inch at hole No. 2, about $0.168\times10^{-3}$ at hole No. 1 and about $0.094\times10^{-3}$ at the standpipe. FIG. 2 also shows that the maximum effective thickness of carbon for each of the probe 10 locations, i.e. hole No. 1, hole No. 2 and the standpipe, occurred at about 17 hours into the coking cycle. Thereafter the probe 10 indicates a decrease in carbon thickness. When such a decrease is noted, it is due to carbon combining with other molecules to form a new compound which leaves the probe 10. For example, oxygen may combine with the carbon to form carbon dioxide, or other compounds in the coke oven gas may combine with the carbon to form a new compound. The oxygen which combines with the carbon to form carbon dioxide may enter the coke oven from the atmosphere if the coke oven pressure goes negative or if there is leakage of waste gas containing excess air into the coke oven from the flues.

FIGS. 2 and 3 show that the coke side was dampered at about 14 hours into the coking cycle and the pusher side was dampered at about $21\frac{3}{4}$ hours. On double collector mains it is standard practice to damper one side at some point in the coking cycle. The other side is dampered just before the end of the coking cycle to isolate the coke oven from the collector mains so that the coke oven can be opened. The choice of when the first side is dampered is up to the coke oven operator. In deciding when to damper the first side, the coke oven operator considers the desire to keep a positive pressure in the coke oven to prevent air from infiltrating into the coke oven. Thus the operator usually reasons that the first side should be dampered just before the end of devolatilization since as long as volatiles are being given off from the coal mass the dampers should be open to prevent pressure buildup in the coke oven. However, if the space between the top of the coal mass is adequate and unblocked and if the standpipe diameters are sufficiently large to handle the gas flow, the first side may be dampered considerably earlier in the coking cycle.

As shown in FIG. 2 the effective thickness of carbon varies dependent on the location of probe 10, i.e. the thickness is greater at hole 2, somewhat less at hole 1 and least at the standpipe. Carbon thickness is created by the coke oven gases depositing carbon on the probe or by having the hydrocarbon coke oven gases thermally crack into carbon and hydrogen on the surface of the probe. The amount of thermal cracking is a function of temperature; for a given quantity of gas—the higher the temperature the greater the percent of gas that will be cracked. From FIGS. 2 and 3, it can be seen that since the temperature at hole 2 is higher than at hole 1 and at the standpipe, the effective carbon thickness at hole 2 is greatest. Likewise, since the temperature at hole 1 is greater than the temperature at the standpipe, the effective carbon thickness is greater at hole 1 than at the standpipe.

The reason for the difference in temperatures between hole 1, hole 2 and the standpipe may be explained as follows. Temperature differences may exist in the free space at the top of a coke oven unintentionally or by design. If the coke oven is heated intentionally so that temperatures increase from pusher side to coke side, such heating can create a temperature gradient across the free space. This gradient may be established so that all the coking is completed at the same time. Since the coke oven tapers in width from the pusher side to the coke side there is more coal at the coke side thus the flue temperatures should be higher at the coke side than at the pusher side. A temperature gradient may also occur when gas flows from one collector main to the other collector main. Such gas flow occurs when the pressure in one main is greater than the pressure in the other main. Thus gas crossflow may occur unintentionally or may be caused intentionally to prevent overheated oven tops and excessive roof carbon.

The standpipe temperature is lower than the temperature in the free space primarily because of heat loss from the standpipe as the gas moves through the standpipe.

Several alternative approaches exist for observing and/or controlling carbon formation on the sensor or probe 10.

In the embodiment shown in FIG. 7 decreasing resistance of the carbon formation is sensed by the probe or sensor 10 and measured by an autoranging digital ohmmeter. Autoranging is required because of the 5-decade resistance changes of the probe or sensor 10. The analog voltage output from the ohmmeter is supplied to a logarithmic converter. The output of the converter becomes the Y input of an X–Y plotter 47'. The X-input to the plotter is obtained from the analog output of a digital stopwatch, which is also logarithmically converted. The resulting plot describes a straight line and actual resistance values at specific times can be read directly from the plot, when log-log paper is used for the plot. A coke oven operator can observe the straight line plot and manually adjust the fuel input to the oven when the slope changes or deviations from the straight line occur.

Referring now to FIG. 8 it is noted that as in the above configuration, the probe resistance is measured by an autoranging digital ohmmeter. The voltage output of the ohmmeter is used as an input signal to a programmer. The programmer compares the input signal in successive time increments with the programmed value desired for any time during the run. If a deviation exists between the input signal and the programmed value at a particular time, an error signal is generated. The error signal is applied to the controller which processes the signal for energizing an alarm, in the event of excess deviation. The controller also generates an output signal for use in making corrective action against the deviation such as driving a valve positioner, which in turn operates the fuel valve(s) for the coke oven.

FIG. 9 depicts a computer controller oven operation. Probe resistance is measured again, with an autoranging digital ohmmeter, the output of which is supplied to a microcomputer. The microcomputer maintains in its memory the information relating to probe resistance vs. time. Input information from the ohmmeter is continually compared to the stored data. Any deviation between the input data and the stored data produces an output from the microcomputer which can be used to take corrective action, energize alarms, or report the deviation to the master computer. The master coke oven computer can also instruct the microcomputer to initiate corrective action in response to other coke oven parameter changes.

The invention described hereinabove provides the method and apparatus to enable the effective thickness of a layer of carbon deposited by a gas on a surface to be determined. The apparatus comprises a cylinder having an outer surface which is characterized by extremely high resistivity, and which is disposed in the path of the flow of the gas with the axis of the cylinder being perpendicular to the direction of flow of the gas. First and second spaced apart wires encircle the cylinder in a plane perpendicular to the axis of the cylinder and serve as electrodes. The spaced apart wires are connected to an electric circuit or electronics package which is remotely located relative to the cylinder. Means is included in the electric circuit for plotting a curve of the resistance between the first and second wires as a function of time, e.g., a strip chart recorder 46, FIG. 6.

Means which include a voltage source, sensor, range setting resistors, feedback amplifier, attenuator and buffer is also provided in the electric circuit for quantitatively measuring the resistance between the first and second wires where they encircle the surface to enable the thickness of a layer of carbon deposited on the surface to be calculated by means of the relationship:

$$t=(\rho l/\pi D\beta T^{X})$$

where t=effective thickness of buildup
l=gage length of probe
D=diameter of probe
$\rho$=electrical resistivity of the carbon
$\beta$=measured electrical resistance of probe at time zero
T=time
X=slope of resistance-time curve.

OPERATION

Referring to FIG. 3, the maximum temperature is indicated to be at about 14¾ hours into the heating cycle. Thus if the operator of the coke oven used temperature as an indicator of the endpoint of devolatilization and added to such temperature indicated endpoint a standard soaking period to bring all coke particles of the coke mass to the proper temperature, the coke oven would have been pushed 2 to 3 hours too soon.

Referring to FIG. 2, the maximum effective carbon thickness which indicates the true devolatilization endpoint occurs at about 17 hours. Thus the addition of a soaking period results in a coke mass having the proper properties.

In addition to indicating the true endpoint of devolatilization, FIG. 2 can be used to control the heat input during the coking cycle since the slope of the curves of FIG. 2 is a measure of the rate of devolatilization and thus a measure of the heat input to the oven. Thus output of the probes 10 can be used as a computer control input to control the firing rate of the coke oven.

Soaking Period

After the end of devolatilization occurs, the coke mass is subjected to further heating to insure that all coke particles are at least at a temperature of about 1800° F. to avoid pushing inadequately heated coke from the coke oven. Thus further heating after the end of devolatilization is often referred to as a soaking period. The amount of time for the soaking period depends on a number of factors—the heat transfer characteristics of the coal-coke mass, the system used to heat the coke ovens, the type of gas offtake, the heating practice and other special considerations.

The heat transfer characteristics of the coal-coke mass are a function of entities such as the thermal conductivity of the coal-coke mass, specific heat of such mass, density of such mass and bulk density of the coke mass.

The system used to heat the coke must have the ability to heat the coal-coke mass uniformly from top to bottom of the coke oven. This ability to so heat the coal-coke mass is a function of entities such as gas nozzle design and location, air port design and location and type of gas used. In addition, the type of refractory material used in the coke oven, the thickness of the refractory material, the flue design used in the coke oven and the constancy of the gas BTU, all play a role in determining the extent of the soaking period.

The type of gas offtake, i.e. single or double main, crossflow of gas, main pressures, dampering time of the main and the presence or absence of flushing liquor in the ovens, influence the extent of the soaking period.

The heating practice used also determines the length of the soaking period, e.g. straight heating or paused heating or reversal time of heating cycle.

Finally special considerations, such as the time interval of open standpipe caps for decarbonization, the tightness of doors and lids of the oven, the leakage between flues and coke ovens, the age of the ovens and the spray practice used to repair the refractory material in the oven, influence the soaking period.

As can be seen, all of the above factors may vary from battery to battery and to a great degree experience in operating a coke oven under varying conditions plays a large part in determining the soaking period. For example soaking periods can vary from 3 hours to 5 hours.

Additional Specific Examples

The following Table I shows the results of additional test data similar to the data shown in FIGS. 2 and 3.

TABLE I

| Test No. | Coking Time Hours | Maximum Temp. °F. | Maximum Effective Thickness of Carbon in. × $10^{-3}$ | Time for Max. Temp. Hours | Time for Max. Carbon Hours |
|---|---|---|---|---|---|
| A | 20.7 | 1400 | 0.66 | 12.5 | 13.5 |
| B | 20.5 | 870 | 0.12 | 13.2 | 14.5 |
| C | 25.1 | 1550 | 0.22 | 22 | 15.8 |
| D | 22.7 | 1600 | 0.26 | 21 | 16.2 |
| E | 25.5 | 1700 | 0.83 | 24.5 | 17.1 |
| F | 21 | 1900 | 0.53 | 20.7 | 13.8 |
| G | 21 | 1900 | 0.43 | 20.5 | 14.3 |
| H | 26.8 | 1250 | 0.02 | 26.8 | * |

* carbon effective thickness still increasing at time of push

Test Nos. A, B, C, D and H were conducted on six meter ovens having two collecting mains. Test Nos. E, F and G were conducted on three meter ovens having one collecting main. The probe and thermocouple location for test No. A was the pusher side standpipe, for test No. B the coke side standpipe, for test Nos. C, D and E No. 2 charging hole, for test No. F No. 3 charging hole, for test No. G No. 5 charging hole and test No. H No. 1 charging hole.

It can be seen that if maximum temperature was used to determine the end of the devolatilization, the coke from the ovens in test Nos. A and B would be pushed too soon and the coke from the ovens in test Nos. C, D, E, F and G would be pushed too late. Since the effective thickness of carbon was increasing when the coke was pushed in test No. H, the oven in test H was pushed too soon.

From the above table it can be seen that the time at which maximum temperature occurs is dependent on the location of the thermocouple. When the thermocouple is located in the standpipe, as in test Nos. A and B, any reduction in gas flow through the standpipe will result in a drop in temperature. As noted above the reduction in gas flow may result from an operating procedure rather than the end of the devolatilization. When the thermocouple is located in the free space at a charging hole, as in test Nos. C-H, heating continues after the end of devolatilization, and the temperatures continue to increase.

Test H is a good example of the need to determine the devolitalization end point in accordance with this invention. During test H, pressure differential from one collection main to the other created a strong cross flow of cooled collector main gases across the free space. As a result, the coke mass at the top of the oven did not reach the desired temperature. This is indicated by the low maximum temperature of 1250° F. in the free space. Thus in spite of a relatively long coking time of 26.8 hours, parts of the coal mass were not completely converted to coke during such time. This is further confirmed by the fact that at the time of pushing, devolatilization was still occurring as indicated by the continuing increase in effective thickness of carbon.

Although I have described my invention hereinabove in considerable detail, I do not wish to be limited narrowly to the exact and specific particulars disclosed, but I may also use such substitutes, modifications, and equivalents as are included within the scope of the invention or pointed out in the appended claims.

I claim:

1. A method of determining the devolatilization endpoint during a coking cycle comprising:
   (a) providing a probe adapted to measure the effective thickness of a layer of carbon deposited by gas released from coal during a coking cycle,
   (b) positioning said probe such that it is exposed to said gas, and
   (c) determining endpoint of devolatilization by providing means electrically connected to said probe to indicate effective thickness of carbon having a maximum value.

2. The method of claim 1 further comprising
   (d) means electrically connected to said probe to indicate the rate of increase of said effective thickness and to control the heat input during the coking cycle.

3. The method of claim 1 wherein the probe comprises:
   (d) a cylinder, the outer surface of which is characterized by extremely high resistivity, said cylinder being disposed in the path of flow of said gas with its axis perpendicular to the direction of flow of said gas,
   (e) first and second spaced apart wires encircling said cylinder in a plane perpendicular to said axis, and
   (f) said first and second spaced apart wires connected to the means of paragraph (c).

4. The method of claim 3 wherein the means of paragraph (c) includes means for plotting a curve of the resistance between said first and second wires as a function of time and, for quantitatively measuring the resistance between said first and second wires where they encircle said surface to enable the thickness of a layer of carbon deposited on said surface to be determined by means of the relationship:

$$t=\rho l/\pi D\beta T^{X}$$

where
   t = the effective thickness of the carbon layer
   l = the distance between said first and second wires where they encircle said cylinder
   D = the outside diameter of said cylinder
   $\beta$ = the initial electrical resistance between said first and second wires where they encircle said cylinder
   $\rho$ = the resistivity of said carbon
   T = time
   x = the slope of the curve at time T.

5. The method of claim 4 further comprising means for indicating the rate of increase of said effective thickness and to control the heat input during the coking cycle.

* * * * *